US008215042B1

(12) United States Patent
Kilmer

(10) Patent No.: US 8,215,042 B1
(45) Date of Patent: Jul. 10, 2012

(54) PICTURE HANGING DEVICE FOR CORNERS

(76) Inventor: James D. Kilmer, Muskego, WI (US)

( * ) Notice: Subject to any disclaimer, the term of this patent is extended or adjusted under 35 U.S.C. 154(b) by 198 days.

(21) Appl. No.: 12/855,619

(22) Filed: Aug. 12, 2010

(51) Int. Cl.
*A47G 1/16* (2006.01)

(52) U.S. Cl. ..... 40/757; 40/745; 248/220.1; 248/475.1

(58) Field of Classification Search ..... 40/671, 40/700, 716, 738, 739, 761, 779, 741; 312/245; 248/493, 472, 479, 480, 495, 536, 326, 220.1–220, 248/41
See application file for complete search history.

(56) References Cited

U.S. PATENT DOCUMENTS 2,078,744 A * 4/1937 Tursky ..... 40/741
2,991,577 A * 7/1961 Bellocchio ..... 40/738
4,555,082 A * 11/1985 Sack et al. ..... 248/220.1
5,042,766 A * 8/1991 Baker ..... 248/200.1
5,094,421 A 3/1992 Zaccone
5,154,384 A 10/1992 Owens
5,373,654 A 12/1994 Whalen
5,464,185 A 11/1995 Hensley
5,810,317 A * 9/1998 Macchi ..... 248/475.1
D448,936 S 10/2001 Duy
6,364,261 B1 4/2002 Vass, Jr.
6,418,590 B1 * 7/2002 Nipper et al. ..... 16/382
6,874,264 B1 * 4/2005 Coito ..... 40/757
7,802,766 B2 * 9/2010 Thompson ..... 248/220.1

* cited by examiner

*Primary Examiner* — Lesley D Morris
*Assistant Examiner* — Shin Kim

(57) ABSTRACT

A picture hanging device for hanging pictures in corners featuring an adjustable first panel comprising a first inner telescopic panel and a first outer telescopic panel; an adjustable second panel comprising a second inner telescopic panel and a second outer telescopic panel, the first end of the second panel is pivotally connected to the second end of the first panel via a first hinge; an adjustable third panel comprising a third inner telescopic panel and a third outer telescopic panel, the first end of the third panel is pivotally attached to the first end of the first panel via a second hinge and the second end of the third panel is pivotally attached to the second end of the second panel via a third hinge; and a sliding hanger disposed on the third panel, the sliding hanger functions to hold a picture being mounted by the picture hanging device.

5 Claims, 4 Drawing Sheets

PICTURE HANGING DEVICE FOR CORNERS

FIELD OF THE INVENTION

The present invention is directed to a device for hanging pictures and frames, more particularly to a device for hanging pictures in a corner.

BACKGROUND OF THE INVENTION

Most often, pictures are hung from flat surfaces. The present invention features a novel picture hanging device for hanging pictures in corners rather than a flat surface. The device can accommodate various angles (of corners) including but not limited to 90 degree angles.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a picture hanging device for hanging a picture in a corner rather than a flat surface. In some embodiments, the picture hanging device comprises an adjustable first panel comprising a first inner telescopic panel and a first outer telescopic panel, the first panel has a first end and a second end; an adjustable second panel comprising a second inner telescopic panel and a second outer telescopic panel, the second panel has a first end and a second end wherein the first end of the second panel is pivotally connected to the second end of the first panel via a first hinge; an adjustable third panel comprising a third inner telescopic panel and a third outer telescopic panel, the third panel has a first end and a second end, wherein the first end of the third panel is pivotally attached to the first end of the first panel via a second hinge and the second end of the third panel is pivotally attached to the second end of the second panel via a third hinge; and a sliding hanger disposed on the third panel, the sliding hanger functions to hold a picture being mounted by the picture hanging device.

In some embodiments, the first panel, the second panel, and the third panel can each be secured at a particular length via a locking mechanism. In some embodiments, the locking mechanism is a screw and aperture mechanism, a clamp mechanism, or a snap mechanism. In some embodiments, the picture hanging device further comprises slots disposed in the first panel and in the second panel, the slots function to allow the picture hanging device to be mounted to a wall via screws, bolts, or nails. In some embodiments, the picture hanging device further comprises slots disposed in the first panel and in the second panel, the slots accommodate the locking that secure the first panel and the second panel at a particular length.

DESCRIPTION OF PREFERRED EMBODIMENTS

Figure 1:
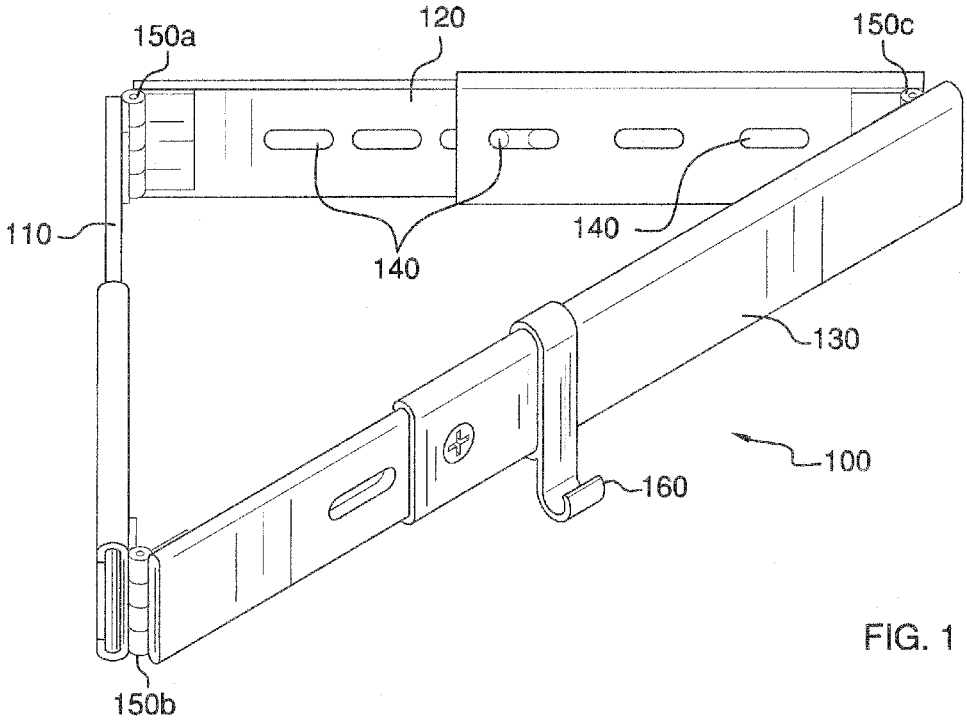
FIG. 1 is a perspective view of the picture hanging device of the present invention.
Figure 2:
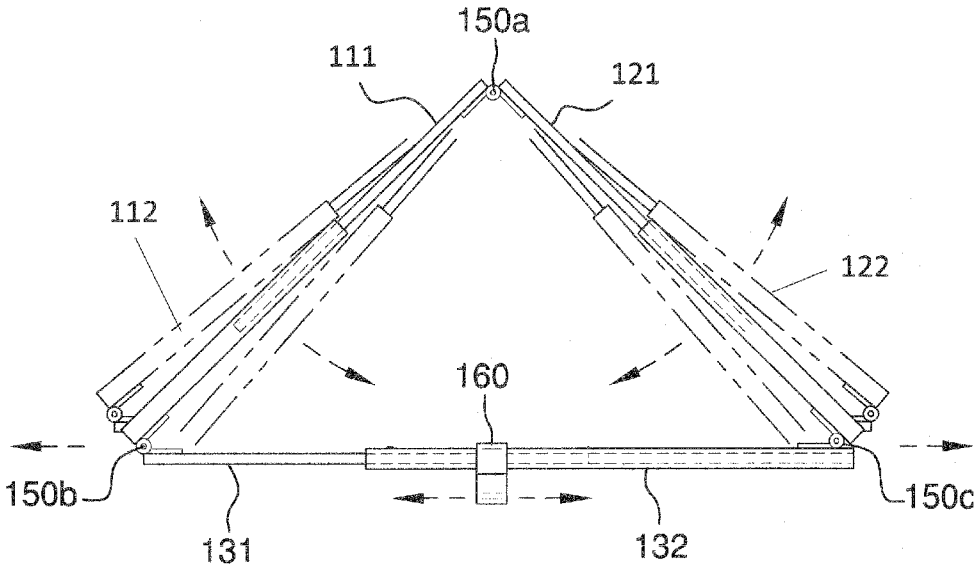
FIG. 2 is a top view of the picture hanging device of FIG. 1.

Referring now to FIGS. 1-5, the present invention features a picture hanging device 100 for hanging pictures in corners rather than a flat surface. The device 100 of the present invention comprises a first panel 110 and a second panel 120. The first panel 110 and second panel 120 are pivotally connected (e.g., the first end of the second panel 120 and the second end of the first panel 110) via a pivot mechanism, for example a first hinge 150*a*. Generally the first panel 110 and second panel 120 are positioned at about a 90 degree angle with respect to each other so as to accommodate a corner of a room. However, the angle is not limited to about 90 degrees. For example, the angle may be between about 30 to 60 degrees, between about 60 to 90 degrees, between about 90 and 120 degrees, etc.

The first panel 110 is adjustable in length. For example, the first panel 110 comprises a first inner telescopic panel 111 and a first outer telescopic panel 112. Telescopic mechanisms are well known to one of ordinary skill in the art. The second panel 120 is adjustable in length. For example, the second panel 120 comprises a second inner telescopic pole 121 and a third outer telescopic panel 122. The first panel 110 and second panel 120 can each be secured at a particular length via a locking mechanism (e.g., a screw and aperture mechanism, a clamp mechanism, a snap mechanism, etc.). In some embodiments, slots 140 are disposed in the first panel 110 and the second panel 120 for accommodating the locking mechanism (e.g., screw and aperture mechanism, see FIG. 3 which shows locking hardware 136 for the third panel 130). In some embodiments, the slots 140 disposed in the first panel 110 and in the second panel 120 allow the first panel 110 and second panel 120 to be attached to the walls in the corner (e.g., via screws and bolts).

Figure 3:
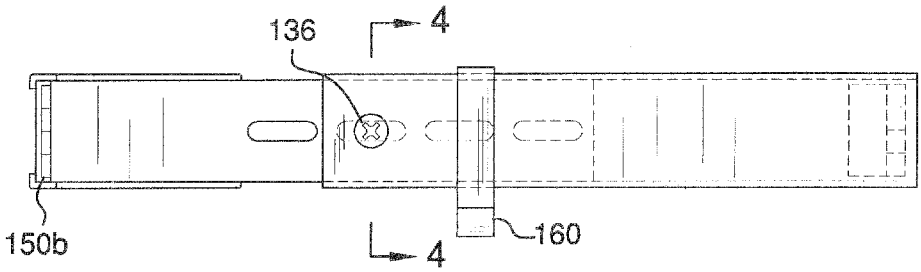
FIG. 3 is a front view of the picture hanging device of FIG. 1.
Figure 4:
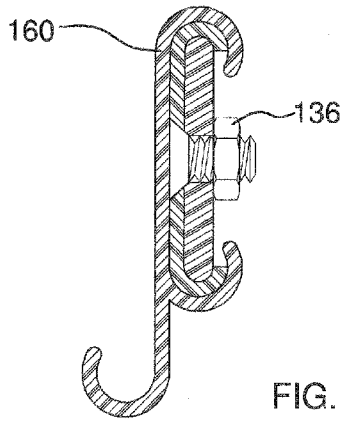
FIG. 4 is a side cross sectional view of the picture hanging device of FIG. 3.
Figure 5:
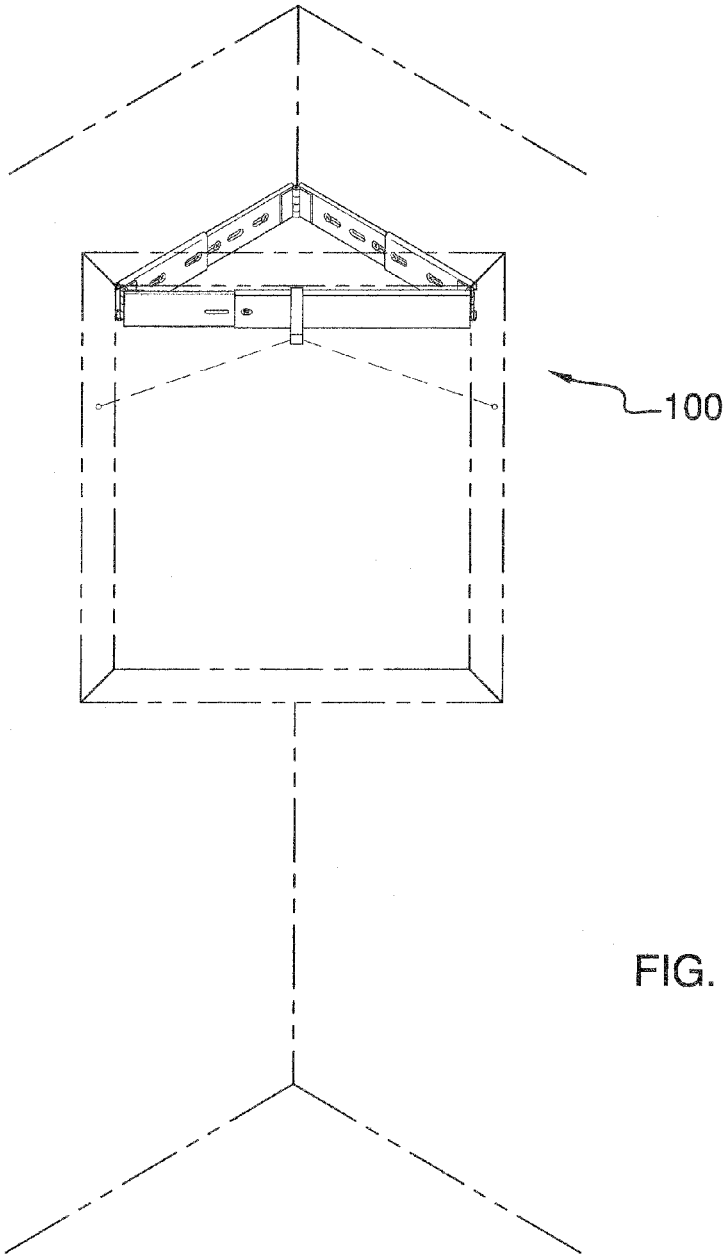
FIG. 5 is an in-use view of the picture hanging device of the present invention.

A third panel 130 is pivotally attached to the first panel 110 and the second panel 120. For example, the first end of the third panel 130 is pivotally attached to the first end of the first panel 110 (e.g., via a second hinge 150*b*), and the second end of the third panel 130 is pivotally attached to the second end of the second panel 120 (e.g., via a third hinge 150*c*). The third panel 130 is adjustable in length. For example, the third panel 130 comprises a third inner telescopic panel 131 and a third outer telescopic panel 132. Telescopic mechanisms are well known to one of ordinary skill in the art. The third panel 130 can be secured at a particular length via a locking mechanism (e.g., a screw and aperture mechanism, a clamp mechanism, a snap mechanism, etc.). FIG. 3, and FIG. 4 show locking hardware 136.

Disposed on the third panel 130 is a sliding hanger 160. The sliding hanger 160 may resemble a hook that can slide along the length of the third panel 130. The sliding hanger 160 functions to hold the picture being mounted.

The device 100 of the present invention may be constructed in a variety of sizes. The hinges 150 and the adjustability of the third panel 130 allow the device 100 of the present invention to adapt to any size corner, providing a great deal of versatility.

As used herein, the term "about" refers to plus or minus 10% of the referenced number. For example, an embodiment wherein the angle is about 90 degrees includes an angle that is between 91 and 99 degrees.

Without wishing to limit the present invention to any theory or mechanism, it is believed that the present invention is advantageous because the device 100 can accommodate a corner with any angle, for example the device 100 is not limited a corner with an angle of about 90 degrees.

The disclosures of the following U.S. Patents are incorporated in their entirety by reference herein: U.S. Pat. No. 5,094,421; U.S. Pat. No. 5,373,654; U.S. Pat. No. 6,364,261; U.S. Pat. No. 5,154,384; U.S. Pat. No. 5,464,185.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A picture hanging device for hanging a picture in a corner, said picture hanging device comprising:

(a) an adjustable first panel comprising a first inner telescopic panel and a first outer telescopic panel, the first panel has a first end and a second end;

(b) an adjustable second panel comprising a second inner telescopic panel and a second outer telescopic panel, the second panel has a first end and a second end wherein the first end of the second panel is pivotally connected to the second end of the first panel via a first hinge;

(c) an adjustable third panel comprising a third inner telescopic panel and a third outer telescopic panel, the third panel has a first end and a second end, wherein the first end of the third panel is pivotally attached to the first end of the first panel via a second hinge and the second end of the third panel is pivotally attached to the second end of the second panel via a third hinge; and (d) a sliding hanger disposed on the third panel, the sliding hanger functions to hold a picture being mounted by the picture hanging device.

2. The picture hanging device of claim 1, wherein the first panel, the second panel, and the third panel can each be secured at a particular length via a locking mechanism.

3. The picture hanging device of claim 2, wherein the locking mechanism is a screw and aperture mechanism, a clamp mechanism, or a snap mechanism.

4. The picture hanging device of claim 1 further comprising slots disposed in the first panel and in the second panel, the slots function to allow the picture hanging device to be mounted to a wall via screws, bolts, or nails.

5. The picture hanging device of claim 2 further comprising slots disposed in the first panel and in the second panel, the slots accommodate the locking mechanisms that secure the first panel and the second panel at a particular length.

* * * * *